US006067723A

United States Patent [19]

Lafrenz

[11] Patent Number: 6,067,723

[45] Date of Patent: May 30, 2000

[54] CLOTHES DRYER HANGING FEATURE

[75] Inventor: Michael D. Lafrenz, Newton, Iowa

[73] Assignee: Maytag Corporation, Newton, Iowa

[21] Appl. No.: 09/240,781

[22] Filed: Jan. 29, 1999

[51] Int. Cl.[7] ..... F26B 19/00

[52] U.S. Cl. ..... 34/61; 34/106; 34/600

[58] Field of Search ..... 34/60, 61, 90, 34/106, 109, 600, 604; 248/206.5, 300, 309 A; D32/25, 35, 36; 223/70, 51, 52

[56] References Cited

U.S. PATENT DOCUMENTS

| | | | |
|---|---|---|---|
| D. 355,008 | 1/1995 | Abel | D32/36 |
| 5,220,734 | 6/1993 | Carver | 34/104 X |
| 5,276,979 | 1/1994 | Gordon, Sr. | 34/109 X |
| 5,333,393 | 8/1994 | Hill et al. | 34/600 X |
| 5,519,949 | 5/1996 | Gibson, Jr. | 34/600 |
| 5,623,769 | 4/1997 | Hayden | 34/61 |
| 5,743,025 | 4/1998 | Jordan, Jr. | 34/600 |

*Primary Examiner*—Stephen Gravini
*Attorney, Agent, or Firm*—Zarley, McKee, Thomte, Voorhees & Sease

[57] ABSTRACT

A hanging feature is provided for a clothes dryer. The hanging feature is included on the door, or on the cabinet adjacent the door opening so that shoes or other objects can be hung from the hanging feature and suspended in a position exposed to the hot air within the rotating drum while at the same time being held free from rotation with the rotating drum.

14 Claims, 5 Drawing Sheets

CLOTHES DRYER HANGING FEATURE

BACKGROUND OF THE INVENTION

This invention relates to a clothes dryer hanging feature for permitting the hanging of certain objects within a clothes dryer so that they will be exposed to the hot air of the clothes dryer, but will not be tumbled with the rotating drum.

Sometimes it is desirable to dry objects which are hard or irregularly shaped. If these objects are placed within the rotating drum of a conventional clothes dryer they make loud noises during tumbling, and may damage the interior structure of the clothes dryer during the tumbling action. An example of such objects might be sneakers or shoes which have become wet and require drying.

Therefore a primary object of the present invention is the provision of an improved clothes dryer having a hanging feature for hanging objects within the dryer.

A further object of the present invention is the provision of a hanging feature which permits objects to be suspended within the clothes dryer without tumbling in response to the rotation of the clothes dryer drum.

A further object of the present invention is the provision of a hanging feature which permits the objects to hang over the door plug of the clothes dryer and directly over the lint filter area of the dryer so as to allow heated air flow to pass directly over them in a drying fashion.

A further object of the present invention is the provision of a hanging feature for a clothes dryer that permits objects to be dried at the same time as items placed on a separate rack.

A further object of the present invention is the provision of a hanging feature which eliminates the need for a separate rack in the drying chamber.

A further object of the present invention is the provision of a clothes dryer hanging feature which is efficient, economical to manufacture, and durable in use.

SUMMARY OF THE INVENTION

The foregoing objects may be achieved by a clothes dryer which includes a top wall, side walls, a rear wall, and a front wall, one of the walls having a cabinet opening therein. A drying container is contained within the cabinet and has a drying cavity for containing clothing or other fabrics to be dried and a container opening registering with the cabinet opening of the cabinet to provide access to the drying cavity from outside the cabinet.

A door is hinged to the cabinet for pivotal movement about a hinge axis from a closed position in covering relation over the cabinet opening to an open position permitting clothing to be placed in the dryer container through the cabinet opening and the container opening. A hanger is on either the door or the cabinet at a location adjacent the cabinet opening. The hanger is adapted to permit the hanging of an article to be dried in a hanging position which exposes the article to the drying chamber of the drying container when the door is in its closed position.

DETAILED DESCRIPTION OF THE PREFERRED EMBODIMENT

Figure 1:
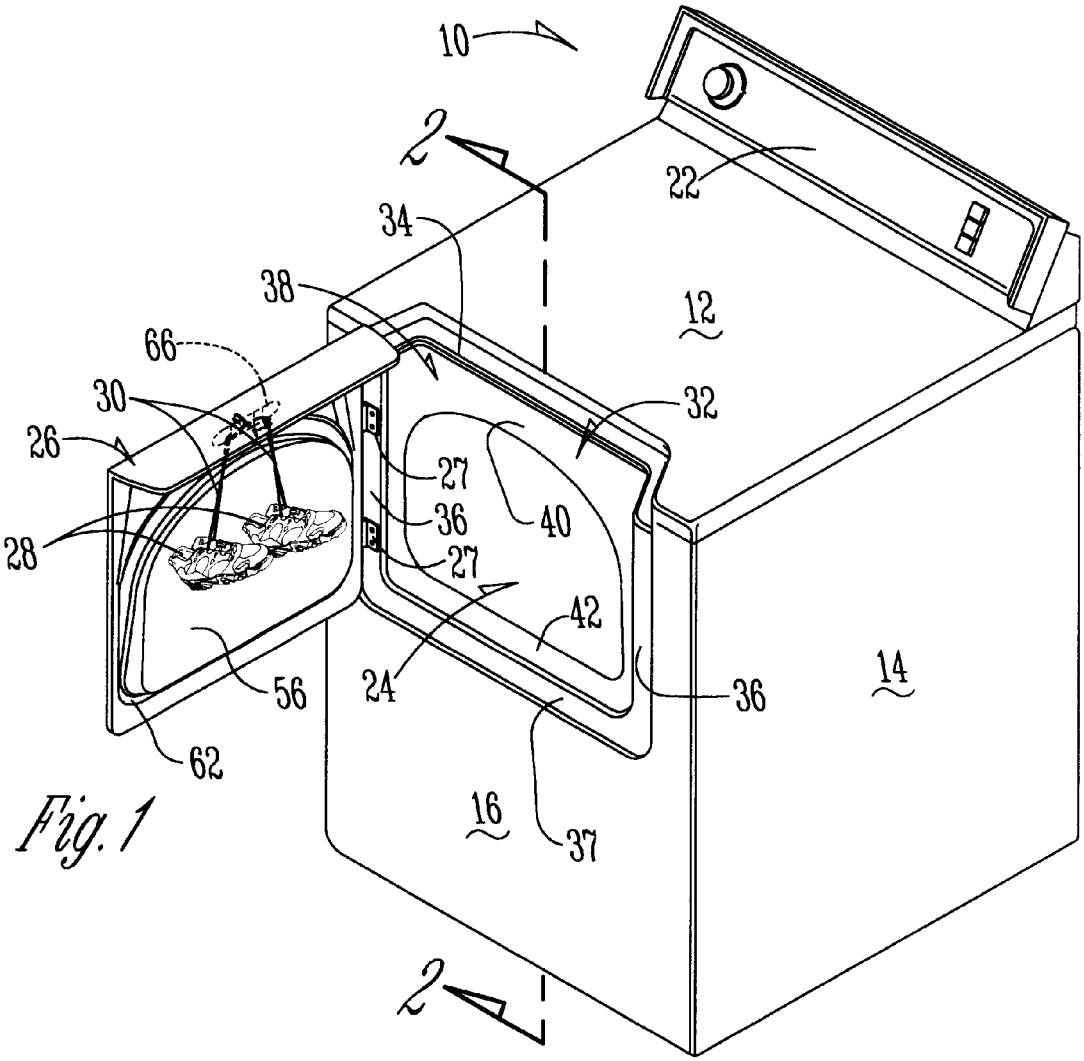
FIG. 1 is a perspective view of a dryer having the hanging feature of the present invention.

Referring to the drawings the numeral 10 generally designates a clothes dryer having a top 12, sides 14, front 16, rear 18 (FIG. 2), and bottom 20. A control panel 22 is provided at the rear of the top 12 in conventional fashion. An access opening 24 is provided in the front 16 also in conventional fashion.

Figure 2:
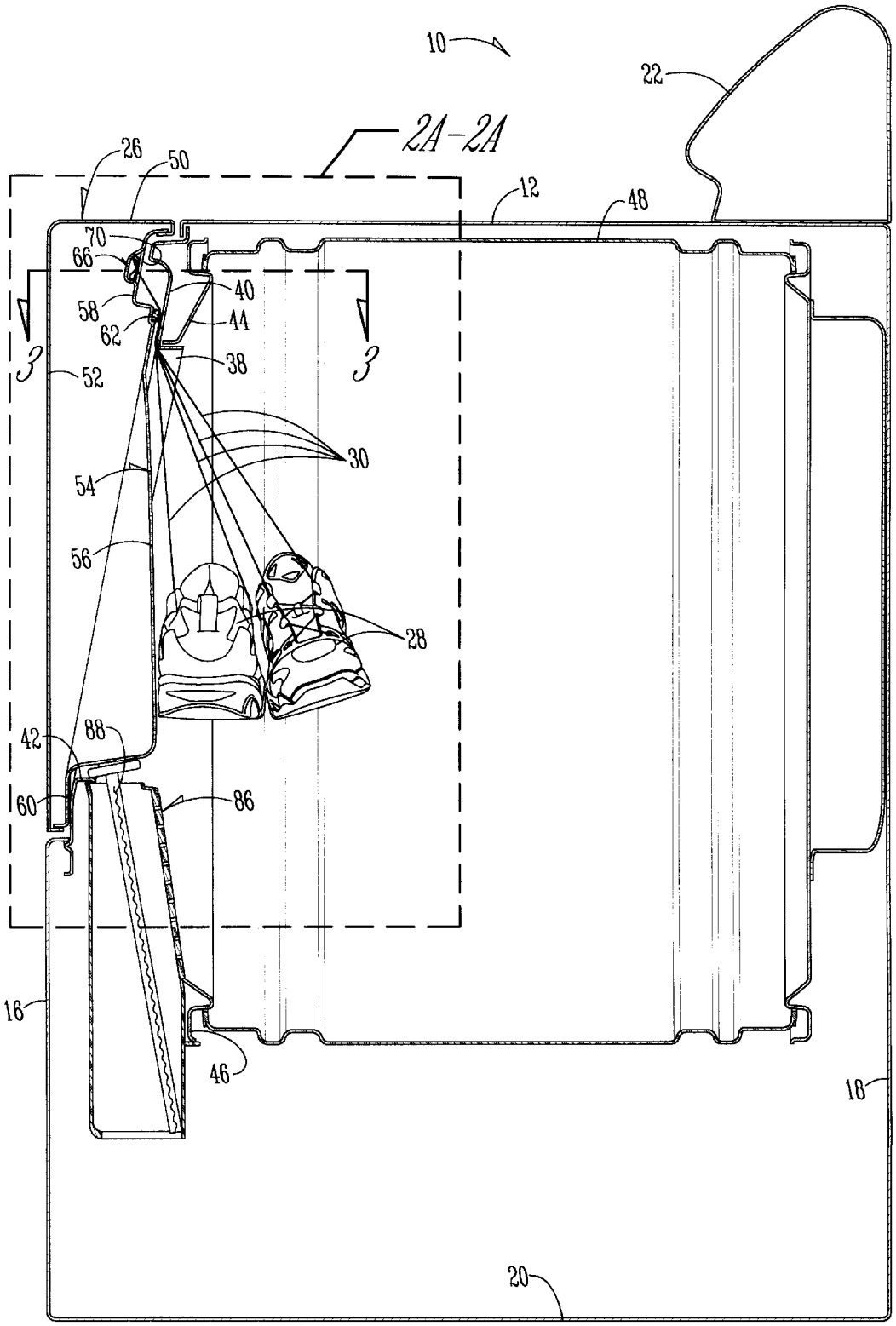
FIG. 2 is a sectional view taken along line 2—2 of FIG. 1.

A door 26 is hinged at one of its sides by hinges 27 to swing from an open position as shown in FIG. 1 to a closed position as shown in FIG. 2. A pair of shoes 28 are shown suspended by their shoe strings 30 from a door hanging feature 66 which will be described in greater detail hereafter.

Top 12 and front 16 of clothes dryer 10 are provided with a door indentation 32 for receiving the door 26 in its closed position. Door indentation 32 includes a top surface 34, side surfaces 36, and a bottom surface 37.

Figure 2A:
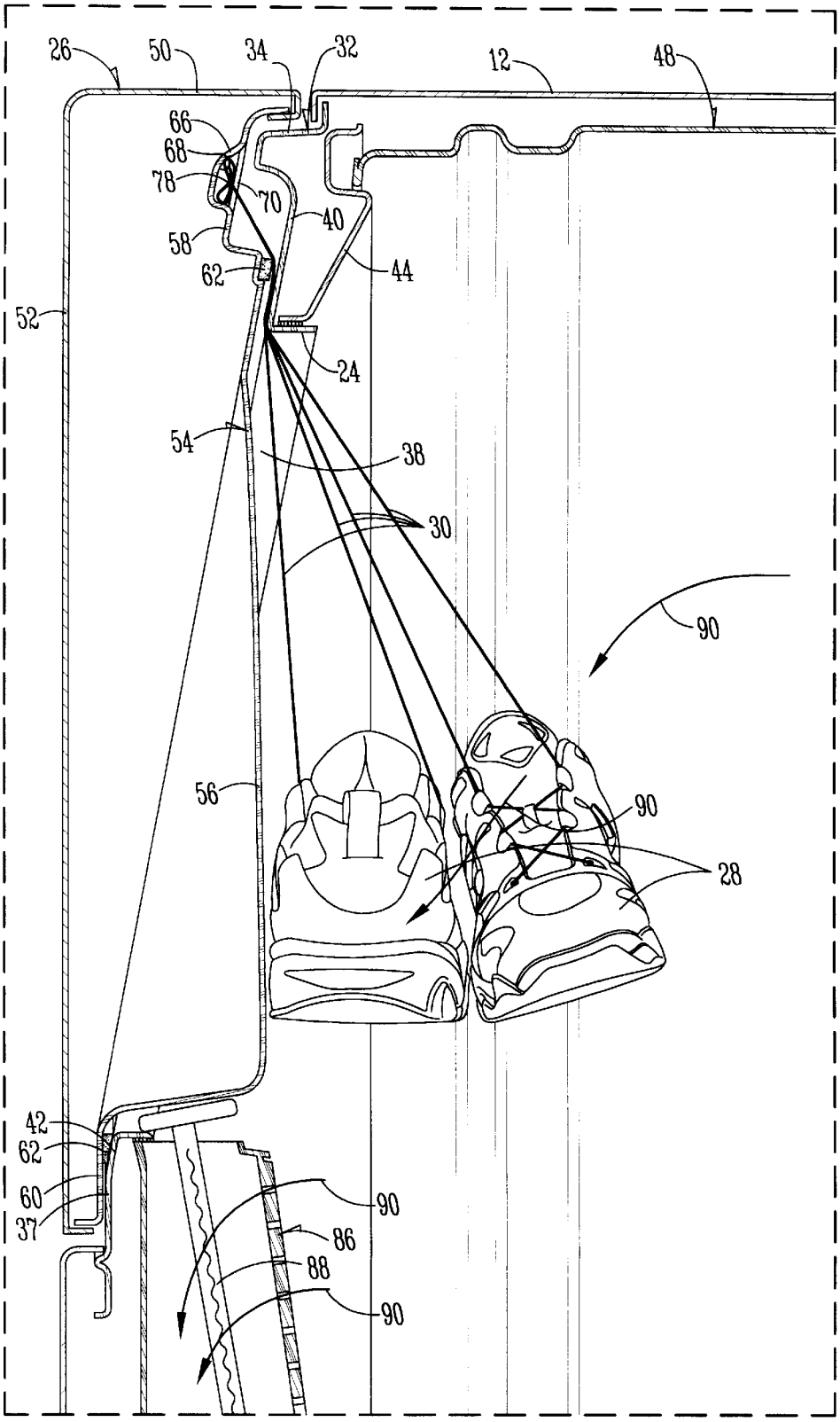
FIG. 2A is an enlarged detail view of a portion of FIG. 2 taken along line 2A—2A.

Referring to FIGS. 2 and 2A the door opening 24 is surrounded by a door skirt 38 having a top front surface 40, a bottom front surface 42, a top interior skirt extension 44, and a bottom interior skirt extension 46. A drum 48 is rotatably mounted within the clothes dryer 10 and is adapted to rotate and tumble clothing in conventional fashion during the time that it is being dried.

The door 26 includes a top panel 50, a front panel 52, and an inner panel 54. Inner panel 54 is comprised of a plug portion 56, an upper portion 58 and a lower portion 60. A seal 62 extends around the plug portion 56 and is shown in FIG. 2 in cross section at the upper edge of plug 56 and at the lower edge of plug 56.

Figure 3:
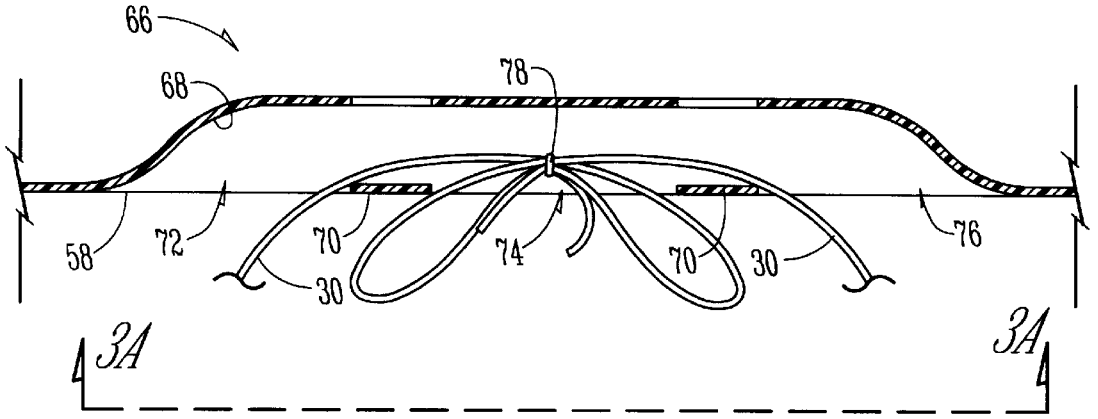
FIG. 3 is a sectional view taken along line 3—3 of FIG. 2.
Figure 3A:
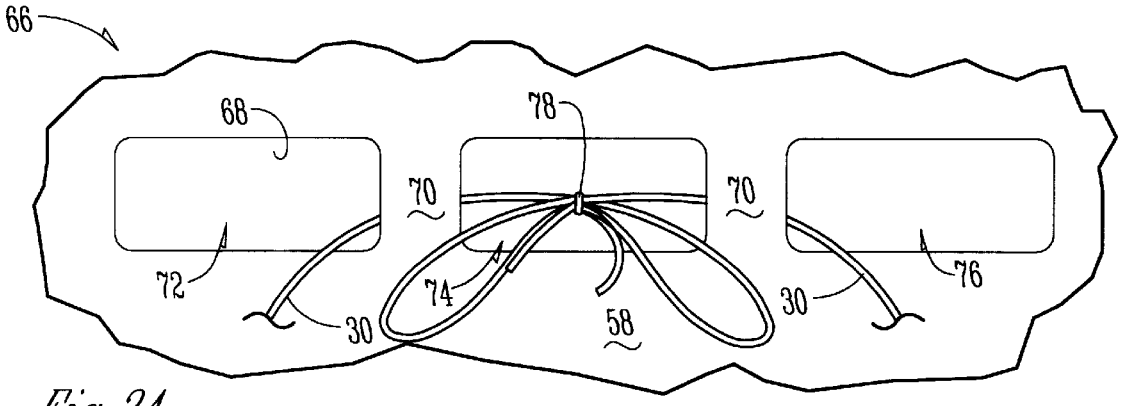
FIG. 3A is a front elevational view taken along line 3A—3A of FIG. 3.

The hanging feature 66 is shown in FIG. 2A to be formed of an indentation 68 which includes bars 70 (FIGS. 3 and 3A) located across its front and which includes three openings 72, 74, 76 intersposed between the bars 70.

The method for using the hanging feature 66 is to insert the strings 30 of the shoes 28 into the side openings 72, 76 and to tie them together into a knot 78 which then is permitted to recess into the indentation 68. The shoes 28 then are suspended in the position shown in FIGS. 2 and 2A so that they are exposed to the interior of the drum 48, but are not permitted to tumble within the drum 48. The shoes 28 are shown suspended immediately above a perforate outlet duct 86 supporting a removable filter 88. This permits the hot air indicated by arrows 90 to pass from the drum 48 over the shoes 28, into the outlet duct 86 and through the filter 88. The shoe strings 30 pass from the hanging feature 66 downwardly between the seal 62 and the top front surface 40 of the door skirt 38. They do not seriously disrupt the sealing function provided by door seal 62.

The hanging feature 66 is shown to be provided in the indentation 68 of inner panel 54. However, the hanging feature 66 could alternatively be provided in the front surface 40 of the skirt 38 without detracting from the invention.

Figure 4:
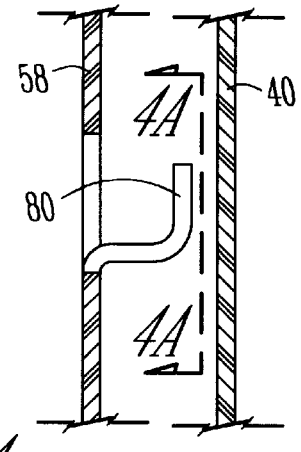
FIG. 4 is a sectional view of a modified form of the hanging feature.
Figure 4A:
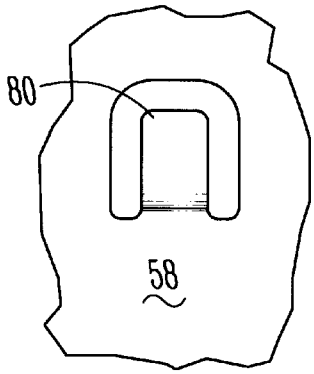
FIG. 4A is a sectional view taken along line 4A—4A of FIG. 4.

Referring to FIGS. 4–4A, a modified form of the hanging feature is shown and is comprised of a rectangularly shaped hook 80 which is molded in the upper portion 58 of the inner door panel 54.

Figure 5:
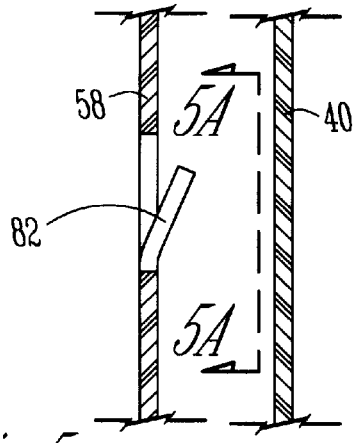
FIG. 5 is a sectional view of a modified form of the hanging feature.
Figure 5A:
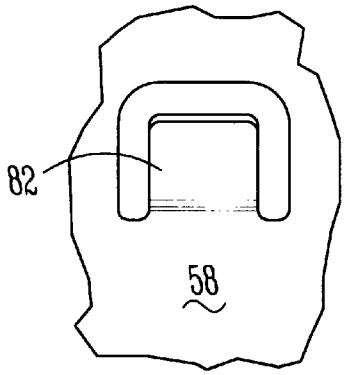
FIG. 5A is a sectional view taken along line 5A—5A of FIG. 5.

FIG. 5–5A shows another modified form of the invention which includes a hook 82 which is straight and does not have a right angle bend such as shown for hook 80 in FIGS. 4–4A.

Figure 5B:
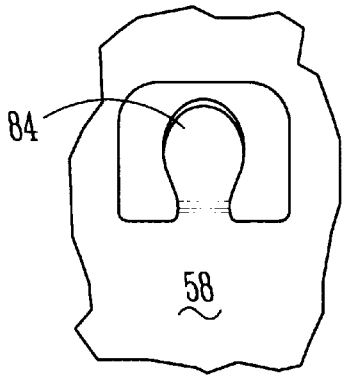
FIG. 5B is a view similar to FIG. 5A but showing still a further modified form of the hanging feature.

FIG. 5B shows another form which can be made for the hook, including a rounded shape such as shown by hook 84.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A clothes dryer comprising:

a cabinet having a top wall, side walls, a rear wall, and a front wall, one of said walls having an cabinet opening therein;

a drying container within said cabinet, said drying container having a drying cavity therein for containing clothing to be dried and a container opening registered with said cabinet opening of said cabinet to provide access to said drying cavity from outside said cabinet;

a door hinged to said cabinet for pivotal movement about a hinge axis from a closed position in covering relation over said cabinet opening to an open position permitting clothing to be placed in said drying container through said cabinet opening and said container opening;

a hanger on one of said door and said cabinet at a location adjacent said cabinet opening, said hanger being adapted to permit the hanging of an article to be dried in a hanging position which is exposed to said drying chamber of said drying container when said door is in said closed position.

2. A clothes dryer according to claim 1 wherein said hanger comprises at least one bar having first and second opposite ends and a central portion therebetween.

3. A clothes dryer according to claim 2 wherein both of said first and second ends of said bar are attached to one of said door and said cabinet.

4. A clothes dryer comprising:

a cabinet having a top wall, side walls, a rear wall, and a front wall, one of said walls having an cabinet opening therein;

a door hinged to said cabinet for pivotal movement about a hinge axis from a closed position in covering relation over said cabinet opening to an open position permitting access to the interior of said cabinet from outside said cabinet;

a drying basket rotatably mounted within said cabinet and having a drying cavity therein for receiving wet items to be dried, said drying basket having a basket opening therein positioned adjacent said cabinet opening during rotation of said drying basket and providing access to said drying cavity from outside said cabinet through said cabinet opening;

a heater for providing heated air to said drying cavity of said drying basket during rotation of said drying basket;

a hanger mounted on one of said cabinet and said door in a position adjacent said cabinet opening, and being adapted to permit hanging of a wet object in a hanging position when said door is in said closed position, wherein said object is exposed to said heated air within said drying cavity while at the same time being free from rotation with said drying basket.

5. A clothes dryer according to claim 4 wherein said hanger comprises at least one bar having first and second opposite ends and a central portion therebetween.

6. A clothes dryer according to claim 5 wherein both of said first and second ends of said bar are attached to one of said door and said cabinet.

7. A clothes dryer according to claim 5 wherein said first end of said bar is a hook which is free from connection to either of said door and said cabinet.

8. In combination:

a cabinet having a top wall, side walls, a rear wall, and a front wall, one of said walls having a cabinet opening therein;

a door hinged to said cabinet for pivotal movement about a hinge axis from a closed position in covering relation over said cabinet opening to an open position permitting access to the interior of said cabinet from outside said cabinet;

a drying basket rotatably mounted within said cabinet and having a drying cavity therein for receiving wet items to be dried, said drying basket having a basket opening therein positioned adjacent said cabinet opening and providing access to said drying cavity from outside said cabinet through said cabinet opening;

a heater for providing heated air to said drying cavity of said drying basket during rotation of said drying basket;

a hanger on one of said door and said cabinet, and being positioned adjacent said cabinet opening and said basket opening;

an item to be dried;

an elongated flexible member retentively engaging said hanger and being connected to said item to be dried;

said flexible member holding said item to be dried in a hanging position which, when said door is in said closed position, causes said item to be exposed to said heated air within said drying cavity and to be free from rotation with said drying basket.

9. A clothes dryer according to claim 8 wherein said hanger comprises at least one bar having first and second opposite ends and a central portion therebetween.

10. A clothes dryer according to claim 9 wherein both of said first and second ends of said bar are attached to one of said door and said cabinet.

11. A clothes dryer according to claim 9 wherein said first end of said bar is a hook which is free from connection to either of said door and said cabinet.

12. A clothes dryer according to claim 9 wherein said flexible member passes around said bar to detachably hang said item to be dried in said hanging position.

13. A clothes dryer according to claim 8 wherein said hanger is located outside said cabinet opening, and said item to be dried is located within said cabinet opening, said flexible member extending from said hanger to said item to be dried.

14. A clothes dryer according to claim 13 wherein said flexible member passes between said one cabinet wall and said door when said door is in said closed position.

* * * * *